United States Patent [19]

Johnson

[11] 4,223,818

[45] Sep. 23, 1980

[54] WOOD CARRIER

[76] Inventor: Carl O. Johnson, Rte. 1, Box 73, Woodstock, Conn. 06281

[21] Appl. No.: 71,364

[22] Filed: Aug. 30, 1979

[51] Int. Cl.[3] ..... B65D 71/00; A47F 7/00; F16M 11/38

[52] U.S. Cl. ..... 224/45 E; 224/151; 224/49; 99/449; 248/166; 211/60 R; 211/49 R

[58] Field of Search ..... 224/45 E, 46 R, 151, 224/45 M, 45 N, 49; 211/60 R, 49 R; 248/150, 165, 166; 99/427, 449; 294/1 R, 15

[56] References Cited

U.S. PATENT DOCUMENTS

| | | | |
|---|---|---|---|
| 353,147 | 11/1886 | Lederle | 220/6 |
| 705,878 | 7/1902 | Shottenberg | 224/45 N |
| 2,703,046 | 3/1955 | Ahlquist | 99/449 |
| 2,966,322 | 12/1960 | Robinson | 248/150 |
| 2,996,463 | 8/1901 | Draper | 260/21 |
| 3,075,798 | 1/1963 | Smith | 99/427 X |
| 3,084,617 | 4/1963 | Jamentz | 99/449 X |
| 3,216,585 | 11/1965 | Whittle | 211/60 R |

FOREIGN PATENT DOCUMENTS 214037 4/1924 United Kingdom .

*Primary Examiner*—Steven M. Pollard
*Attorney, Agent, or Firm*—Charles R. Fay

[57] ABSTRACT

A wood carrier in two separable parts, the parts being shaped in complementary angular form to carry wood, store it, and having means to selectively separate the parts to dump the wood.

5 Claims, 3 Drawing Figures

WOOD CARRIER

BACKGROUND OF THE INVENTION

With many people burning more wood in stoves and fireplaces, it becomes of benefit to provide an easily manipulated carrier that also may act as a storage bin. Also in the present case, it is provided with a removable pin that allows the parts of the carrier to swing apart or separate and to drop the load of wood in a pile or wood box.

SUMMARY OF THE INVENTION

A pair of similar parts are made of spaced rod or tubing and are bent to present facing floor engaging elements and spaced concave uprights. Each part is provided with an exterior projecting handle engaging the floor at each end of the carrier, and the parts are articulated by a removable pin at the center of the carrier. The carrier, full of wood, can be set on the floor and the curved uprights stay upright due to the fact that the connected portions rest on the floor centrally of the carrier and the projecting handles aid in maintaining this condition even though the carrier should be empty.

Extra handles are available for carrying, and the members are made in spaced side runs with curved ends for the uprights, and these may be used for handles also.

The carrier may be set on the floor in another condition, i.e., resting on the first-named handles with the articulated center raised, increasing the wood storage capacity of the device.

The weight of the contents cause the uprights to tend to swing toward each other about the pin as a center, rendering the carrier easier to transport. The carrier can be placed on the floor forming its own storage, or the pin can be pulled and the entire load dumped. The curvature of the uprights creates forces clamping the contents, when carried.

PREFERRED EMBODIMENT OF THE INVENTION

Figure 1:
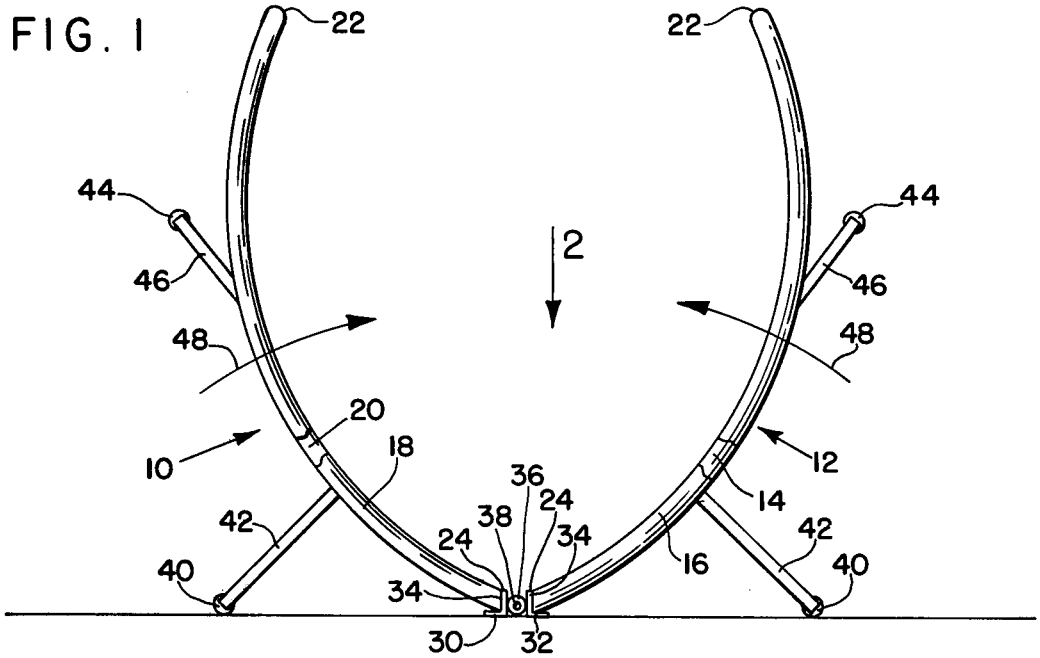
FIG. 1 is a view in side elevation.
Figure 2:
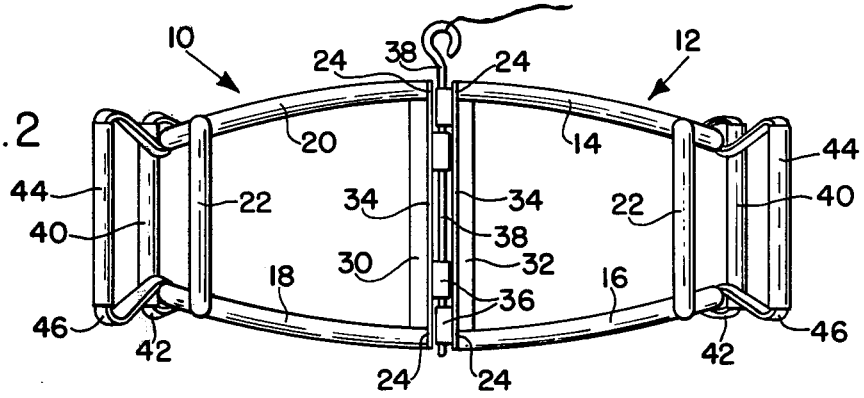
FIG. 2 is a plan view looking in the direction of arrow 2 in FIG. 1.

A pair of generally U-shaped, curved members of rod or tubing as at 10 and 12 face each other and gradually diverge downwardly as at 14, 16, 18 and 20. They each have an end 22 by which they can be lifted and are provided at their wider ends, opposite parts 22, with angle-irons 24 welded thereto. Each angle-iron has a horizontal flange 30, 32 and a vertical flange 34 to which are connected rings or cylinders 36, 36 through which extends a selectively removable pin 38 articulating the parts.

There are ground-engaging handles 40, 40 secured intermediate the ends of the U-shaped parts, these handles forming the closed ends of U-shaped members 42, 42, and still further handles 44, 44 on U-shaped members 46, 46 are secured to the parts 10 and 12 intermediate handles 40 and 22.

With the device in the FIG. 1 position it can be filled with logs and grasped by handles 22, the parts 10 and 12 tend to swing in towards each other, see arrows 48. The handles 44 can be used the same way, or may be grasped by two persons.

Figure 3:
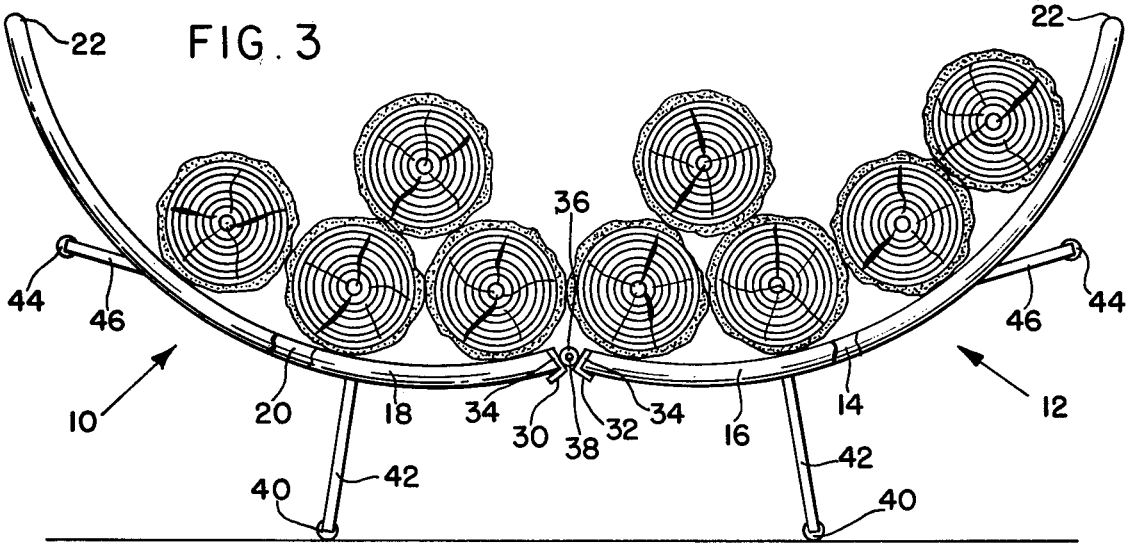
FIG. 3 is a view similar to FIG. 1 showing a different disposition of the carrier.

The handles 40 engage the ground and hold the carrier upright whether it is in the FIG. 1 position or the FIG. 3 position. In the latter case, more wood can be held and carried, it being noted that the flanges 30, 32 also engage the ground in FIG. 1, but do not do so in the FIG. 3 position.

When the pin 38 is pulled, the load of wood is not merely dumped but is deposited in a parallel orderly configuration, greatly increasing its usefulness.

I claim:

1. A wood carrier comprising two like parts, each part formed of elongated material in the form of a U, the open ends of the two Us being adapted to be separably connected, a removable pin connecting the parts at their open ends, each part being bent to provide curved portions facing each other, handles projecting exteriorly of the parts intermediate the ends thereof, said handles together supporting the carrier on floor or ground with the parts in generally spaced relation providing storage for the wood, and means at the open ends of the parts engaging the ground in coplanar relation with the handles, or being selectively raised, spreading the parts, and enlarging the capacity of the carrier as it rests only on the handles.

2. The wood carrier of claim 1 wherein the closed ends of the Us provide carrying handles.

3. The wood carrier of claim 1 including means to grasp and pull the pin to dump a load of wood as the parts separate under the weight of the wood in the carrier.

4. The wood carrier of claim 1 including a second pair of handles on the parts intermediate the closed ends of the Us and the first-named handles.

5. The wood carrier of claim 1 wherein the handles form the closed ends of U-shaped brackets attached at their open ends to the respective parts.

* * * * *